US011118539B2

(12) United States Patent
Miyabe et al.

(10) Patent No.: US 11,118,539 B2
(45) Date of Patent: Sep. 14, 2021

(54) EVAPORATED FUEL TREATMENT APPARATUS

(71) Applicant: AISAN KOGYO KABUSHIKI KAISHA, Obu (JP)

(72) Inventors: Yoshikazu Miyabe, Obu (JP); Masanobu Shinagawa, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/928,123

(22) Filed: Jul. 14, 2020

(65) Prior Publication Data

US 2021/0040920 A1 Feb. 11, 2021

(30) Foreign Application Priority Data

Aug. 8, 2019 (JP) ..... JP2019-146352

(51) Int. Cl.
*F02M 25/08* (2006.01)
*F02D 41/24* (2006.01)
*F02D 41/00* (2006.01)

(52) U.S. Cl.
CPC ..... *F02M 25/0836* (2013.01); *F02D 41/004* (2013.01); *F02D 41/2441* (2013.01); *F02M 25/0809* (2013.01); *F02M 25/089* (2013.01); *F02M 25/0854* (2013.01)

(58) Field of Classification Search
CPC ..... F02M 25/0836; F02M 25/0854; F02M 25/0809; F02M 25/089; F02D 41/2441; F02D 41/004
See application file for complete search history.

(56) References Cited

U.S. PATENT DOCUMENTS 7,341,048 B2 * 3/2008 Koyama ..... F02D 41/0042 123/518
9,777,679 B2 * 10/2017 Shimokawa ..... F02M 25/0854
10,907,583 B2 * 2/2021 Honda ..... F02M 25/0836
2004/0173190 A1 * 9/2004 Makino ..... F02M 25/0836 123/520
2016/0031318 A1 * 2/2016 Shimokawa ..... F02M 25/0854 206/0.7

FOREIGN PATENT DOCUMENTS

JP 2016-031054 A 3/2016

* cited by examiner

*Primary Examiner* — Xiao En Mo
(74) *Attorney, Agent, or Firm* — Oliff PLC

(57) ABSTRACT

In an evaporated fuel treatment apparatus including a bypass passage branching from an atmosphere passage and connected to a canister by detouring around at least one ii and a bypass valve to open and close the bypass passage, a controller holds the bypass valve in a closed state until an integrated purge flow rate reaches a predetermined value after start of purge control, the integrated purge flow rate being an integrated value of flow rate of purge gas flowing through a purge passage. When the integrated purge flow rate reaches the predetermined value, the controller turns the bypass valve to an open state.

6 Claims, 18 Drawing Sheets

XX: BYPASS PASSAGE CHARACTERISTIC
YY: INTERMEDIATE-POINT ESTIMATION CHARACTERISTIC
ZZ: NORMAL PASSAGE CHARACTERISTIC

EVAPORATED FUEL TREATMENT APPARATUS

CROSS-REFERENCE TO RELATED APPLICATIONS

This application is based upon and claims the benefit of priority from the prior Japanese Patent Applications No. 2019-146352 filed on Aug. 8, 2019, the entire contents of which are incorporated herein by reference.

BACKGROUND

Technical Field

The present disclosure relates to an evaporated fuel treatment apparatus for treatment to introduce evaporated fuel generated in a fuel tank to an engine.

Related Art

Improved fuel consumption reduces the frequency of driving an engine, leading to a reduced opportunity to purge a canister under the engine negative pressure. This causes an increase in the amount of fuel (i.e., hydrocarbon (HC)) remaining in activated carbon in the canister. Thus, the amount of fuel to be released from the canister through its atmosphere port is apt to increase while a vehicle is parked, that is, during parking. Some countermeasures against such a defect are conceivable; for example, high-performance activated carbon is used in the canister or another canister is additionally provided in the outside of the atmosphere port. However, these countermeasures may lead to increased cost of the apparatus and increased size of the canister.

Herein, as a conventional art, Japanese unexamined patent application publication No. 2016-31054 discloses a canister for an internal combustion engine, in which a plurality of adsorption layers and a plurality of space layers, a bypass passage for bypassing some of the adsorption layers, and a flow control valve placed on the bypass passage. This valve operates to control a flow rate of purge gas passing through the bypass passage based on the flow velocity of the purge gas.

SUMMARY

Technical Problems

However, opening/closing control of the bypass passage is not performed according to a purge state of the canister, that is, a release state of fuel in the adsorption layers. This leads to insufficient purging in the adsorption layers (i.e., insufficient releasing of fuel from the adsorption layers) located more downstream than the adsorption layer just next to the atmosphere port, that is, located at a position closer to a purge port, and may cause an increase in the amount of evaporated fuel to be released from the canister to the atmosphere during parking.

The present disclosure has been made to address the above problems and has a purpose to provide an evaporated fuel treatment apparatus capable of reducing the amount of evaporated fuel to be released from a canister to the atmosphere during parking.

Means of Solving the Problems

To achieve the above-mentioned purpose, one aspect of the present disclosure provides an evaporated fuel treatment apparatus including: a canister including a plurality of adsorption layers for adsorbing evaporated fuel and a space layer that is a space formed between the adsorption layers; a purge passage configured to allow purge gas containing the evaporated fuel to flow from the canister to an engine; a purge valve configured to open and close the purge passage; an atmosphere passage configured to take atmospheric air into the canister; a controller configured to perform purge control by placing the purge valve in an open state to introduce the purge gas from the canister into the engine through the purge passage; a bypass passage branching off from the atmosphere passage and connecting to the canister by detouring around at least one of the adsorption layers; and a bypass valve configured to open and close the bypass passage, wherein, after start of the purge control, the controller is configured to hold the bypass valve in a closed state until an integrated purge flow rate reaches a predetermined value, the integrated purge flow rate being an integration value of flow rates of the purge gas flowing through the purge passage, and then turn the bypass valve to an open state when the integrated purge flow rate reaches the predetermined value.

According to the above aspect, when the integrated purge flow rate reaches a predetermined value, which is considered that the amount of fuel adsorbed in the adsorption layers has increased, atmospheric air is directly introduced, through the bypass passage, into the adsorption layer(s) more downstream than the adsorption layer located at a position close to the atmosphere passage. This facilitates release or separation of the fuel adsorbed in the downstream adsorption layer. Therefore, during parking, the evaporated fuel treatment apparatus can reduce the amount of evaporated fuel that moves by diffusion from the adsorption layer on the downstream side to the adsorption layer on the atmosphere passage side, thereby preventing release of the evaporated fuel from the atmosphere passage to the atmosphere. Thus, the amount of evaporated fuel to be released from the canister to the atmosphere during parking can be reduced.

The evaporated fuel treatment apparatus in the present disclosure configured as above can reduce the amount of evaporated fuel to be released from a canister to the atmosphere during parking.

DETAILED DESCRIPTION OF THE EXEMPLARY EMBODIMENTS

A detailed description of embodiments of an evaporated fuel treatment apparatus according to the present disclosure will now be given referring to the accompanying drawings. In the embodiments described below, the evaporated fuel treatment apparatus of the present disclosure is applied to an engine system to be mounted in a vehicle, such as a car.

First Embodiment

A first embodiment will be described below.

<Outline of Evaporated Fuel Treatment Apparatus>

Figure 1:
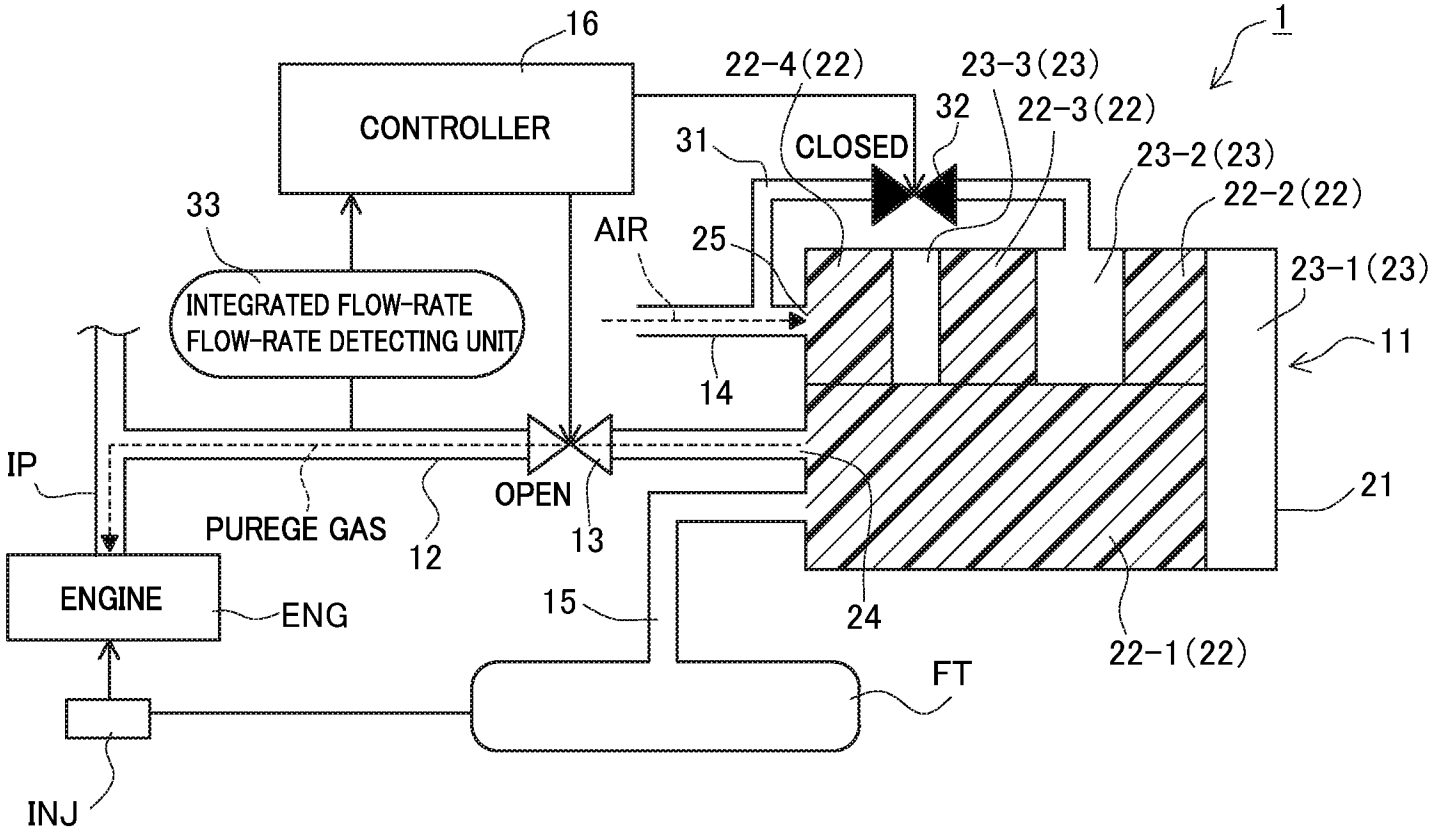
FIG. 1 is an entire configuration diagram of an evaporated fuel treatment apparatus in a first embodiment, showing a closed state of a bypass passage.
Figure 2:
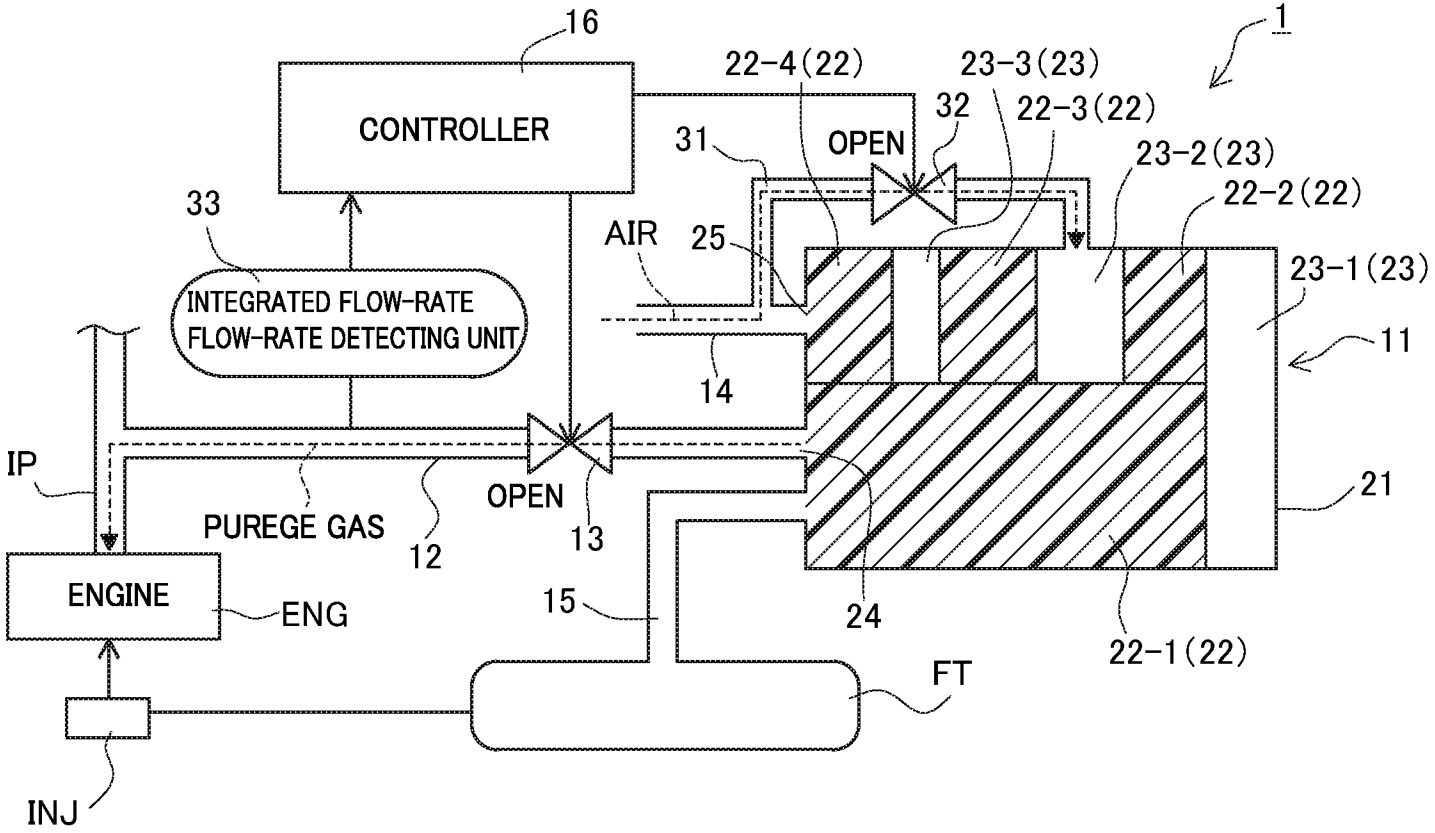
FIG. 2 is an entire configuration diagram of the evaporated fuel treatment apparatus in the first embodiment, showing an open state of the bypass passage.

An evaporated fuel treatment apparatus 1 in the present embodiment is an apparatus configured to introduce evaporated fuel generated in a fuel tank FT into an engine ENG through an intake passage IP. This evaporated fuel treatment apparatus 1 includes a canister 11, a purge passage 12, a purge valve 13, an atmosphere passage 14, a vapor passage 15, a controller 16, and others, as shown in FIGS. 1 and 2.

The canister 11 is connected to the fuel tank FT through the vapor passage 15 and configured to temporarily store evaporated fuel flowing therein from the fuel tank FT through the vapor passage 15. The canister 11 communicates with the purge passage 12 and also with the atmosphere passage 14.

The canister 11 is provided with a canister case 21, activated carbons 22 (one example of an adsorption layer of the present disclosure), and space chambers 23 (one example of a space layer of the present disclosure).

The canister case 21 is a container for storing evaporated fuel flowing therein from the fuel tank FT through the vapor passage 15. This canister case 21 is provided with a purge port 24 and an atmosphere port 25. The purge port 24 is an outlet port to allow purge gas (i.e., a gas that contains purge air (atmospheric air) and evaporated fuel) to flow out of the canister case 21. The atmosphere port 25 is an inlet port to allow purge air to flow into the canister case 21 from the atmosphere.

The activated carbon 22 is an adsorbent capable of adsorbing thereon evaporated fuel generated in the fuel tank FT. This activated carbon 22 is provided in a plurality of layers in the canister case 21. In this embodiment, as one example, the activated carbon 22 is provided in four layers in the canister case 21. Specifically, these four layers of the activated carbon 22 include a first layer of activated carbon ("first-layer activated carbon") 22-1, a second-layer activated carbon 22-2, a third-layer activated carbon 22-3, and a fourth-layer activated carbon 22-4, which are arranged in this order in the canister case 21 from a position close to the purge port 24 to a position close to the atmosphere port 25.

The space chamber 23 is a space region formed in the canister case 21. In the present embodiment, as one example, the space chamber 23 is provided in three space layers in the canister case 21. Specifically, these three space layers include a first space chamber 23-1, a second space chamber 23-2, and a third space chamber 23-3.

The first space chamber 23-1 is formed between the first-layer activated carbon 22-1 and the second-layer activated carbon 22-2. The second space chamber 23-2 is formed between the second-layer activated carbon 22-2 and the third-layer activated carbon 22-3. The third space chamber 23-3 is formed between the third-layer activated carbon 22-3 and the fourth-layer activated carbon 22-4.

The purge passage 12 is connected to the intake passage IP and also to the canister 11. This configuration allows the purge gas that flows out of the canister 11, i.e., the gas containing evaporated fuel, to flow through the purge passage 12 into the intake passage IP.

The purge valve 13 is placed in the purge passage 12. This purge valve 13 is configured to open and close the purge passage 12. While the purge valve 13 is in a closed state, the purge gas in the purge passage 12 is shut off by the purge valve 13 from flowing to the intake passage IP. While the purge valve 13 is in an open state, on the other hand, the purge gas is allowed to flow into the intake passage IP.

The atmosphere passage 14 has one end that is open to the atmosphere and the other end that is connected to the canister 11 to permit the canister 11 to communicate with the atmosphere. The atmosphere passage 14 is configured to take atmospheric air into the canister 11.

The vapor passage 15 is connected to the fuel tank FT and also to the canister 11. This allows the evaporated fuel in the fuel tank FT to flow in the canister 11 through the vapor passage 15.

The controller 16 is a part of an ECU (not illustrated) mounted in a vehicle and placed integral with other parts of the ECU (e.g., parts for controlling the engine ENG). This controller 16 may be provided separately from the other parts of the ECU. The controller 16 includes a CPU, a ROM, a RAM, and others. The controller 16 is configured to control the evaporated fuel treatment apparatus 1 and the engine system according to programs stored in advance in a memory. For instance, the controller 16 is configured to control the purge valve 13 and a bypass valve 32 which will be mentioned later. Furthermore, the controller 16 is configured to receive the information about a detected value corresponding to an integrated value of flow rates of purge gas flowing through the purge passage 12 from an integrated-flow-rate detecting unit 33 which will be described later.

In the present embodiment, the evaporated fuel treatment apparatus 1 includes a bypass passage 31, the bypass valve 32, and the integrated-flow-rate detecting unit 33.

The bypass passage 31 branches off from the atmosphere passage 14 and is connected to, i.e., opens into, the second space chamber 23-2 of the canister 11 by detouring around the fourth-layer activated carbon 22-4 and the third-layer activated carbon 22-3. The bypass valve 32 is placed in the bypass passage 31 and configured to open and close the bypass passage 31. Furthermore, the integrated-flow-rate detecting unit 33 is configured to detect an integrated purge flow rate which is an integrated value of flow rates of purge gas flowing through the purge passage 12.

In the evaporated fuel treatment apparatus 1 configured as above, if a purge condition is satisfied during operation of the engine ENG, the controller 16 performs the purge control by placing the purge valve 13 in an open state to introduce purge gas from the canister 11 into the engine ENG through the purge passage 12 and the intake passage IP under the engine negative pressure. Herein, the "engine negative pressure" represents the negative pressure generated in the purge passage 12 and the intake passage IP when the engine ENG is driven.

At that time, concretely, the canister 11 is subjected to the following purge process, that is, a separation process of fuel adsorbed on the activated carbon 22. Firstly, the purge air, i.e., atmospheric air, flows from the atmosphere into the fourth-layer activated carbon 22-4 through the atmosphere port 25, thereby causing separation of the fuel adsorbed on the fourth-layer activated carbon 22-4. Then, the purge gas, i.e., a mixture gas of the purge air and evaporated fuel, flows from the fourth-layer activated carbon 22-4 into the third-layer activated carbon 22-3 through the third space chamber 23-3, thereby causing separation of the fuel adsorbed on the third-layer activated carbon 22-3. Subsequently, the purge gas flows from the third-layer activated carbon 22-3 into the second space chamber 23-2, the second-layer activated carbon 22-2, the first space chamber 23-1, and the first-layer activated carbon 22-1 in sequence. The fuel adsorbed on the second-layer activated carbon 22-2 and the first-layer activated carbon 22-1 is separated therefrom as above and also the purge gas flows to the purge passage 12 through the purge port 24.

While the purge control is being executed, the engine ENG is supplied with the air taken into the intake passage IP, the fuel injected from the fuel tank FT through the injector INJ, and further the purge gas introduced into the intake passage IP under the purge control. The controller 16 is also configured to adjust the injection time of the injector INJ, the opening time of the purge valve 13, and others to regulate an air-fuel ratio (A/F) of the engine ENG to an optimum air-fuel ratio, for example, an ideal air-fuel ratio.

<Opening/Closing Control of Bypass Passage>

In the present embodiment, during running of a vehicle, after start of the purge control, the controller 16 holds the bypass valve 32 in a closed state (see FIG. 1) until an integrated purge flow rate reaches a predetermined value A and then places the bypass valve 32 in an open state (see FIG. 2) when the integrated purge flow rate reaches the predetermined value A. Thus, after the start of purge control, when the integrated purge flow rate reaches the predetermined value A, the bypass passage 31 is turned from the closed state to the open state.

Accordingly, when the integrated purge flow rate reaches the predetermined value A after the start of execution of the purge control, the canister 11 is switched from a normal passage communicating state for allowing the atmospheric air to be taken in the canister 11 through the atmosphere passage 14 and the atmosphere port 25 of the canister 11 to a bypass passage open state for allowing the atmospheric air to be taken in the second space chamber 23-2 of the canister 11 through the atmosphere passage 14 and the bypass passage 31. In this bypass passage open state, the atmospheric air is also taken in the canister 11 (i.e., the second space chamber 23-2) through the atmosphere passage 14 and the atmosphere port 25 of the canister 11, even though it is very small in amount because of the intervening third-layer activated carbon 22-3 and fourth-layer activated carbon 22-4.

In the above manner, when the integrated purge flow rate reaches the predetermined value A and thus it is estimated that the amount of fuel adsorbed in the activated carbon 22 has increased, the bypass valve 32 is turned to the open state, thereby opening the bypass passage 31. Accordingly, the atmospheric air is directly fed from the atmosphere passage 14 into the second-layer activated carbon 22-2 located more downstream than the third-layer activated carbon 22-3 and the fourth-layer activated carbon 22-4 (that is, the adsorption layers located close to the atmosphere passage) in the canister 11 through the bypass passage 31. Since the atmospheric air is directly introduced into the second-layer activated carbon 22-2 through the bypass passage 31, the air not containing evaporated fuel flows in the second-layer activated carbon 22-2, so that this second-layer activated carbon 22-2 is warmed by the air. This facilitates separation of the fuel adsorbed on the second-layer activated carbon 22-2 and the first-layer activated carbon 22-1, so that the amount of fuel adsorbed on those second-layer activated carbon 22-2 and first-layer activated carbon 22-1 can be reduced. Accordingly, during parking, when the engine ENG is stopped, the above configuration can reduce the amount of evaporated fuel that moves by diffusion from the second-layer activated carbon 22-2 to the third-layer activated carbon 22-3 and the fourth-layer activated carbon 22-4, and thus can prevent release of the evaporated fuel from the atmosphere passage 14 to the atmosphere through the atmosphere port 25. This makes it possible to reduce the amount of evaporated fuel to be released from the canister 11 to the atmosphere during parking.

The above condition, "when the integrated purge flow rate reaches the predetermined value A", concretely represents "at the same time as an integrated purge flow rate arrival time at which the integrated purge flow rate reaches the predetermined value A" or "after the integrated purge flow rate arrival time".

Thus, the controller 16 performs the following controls in Examples described below in relation to the above opening/closing control of the bypass passage 31.

EXAMPLE 1

Figure 3:
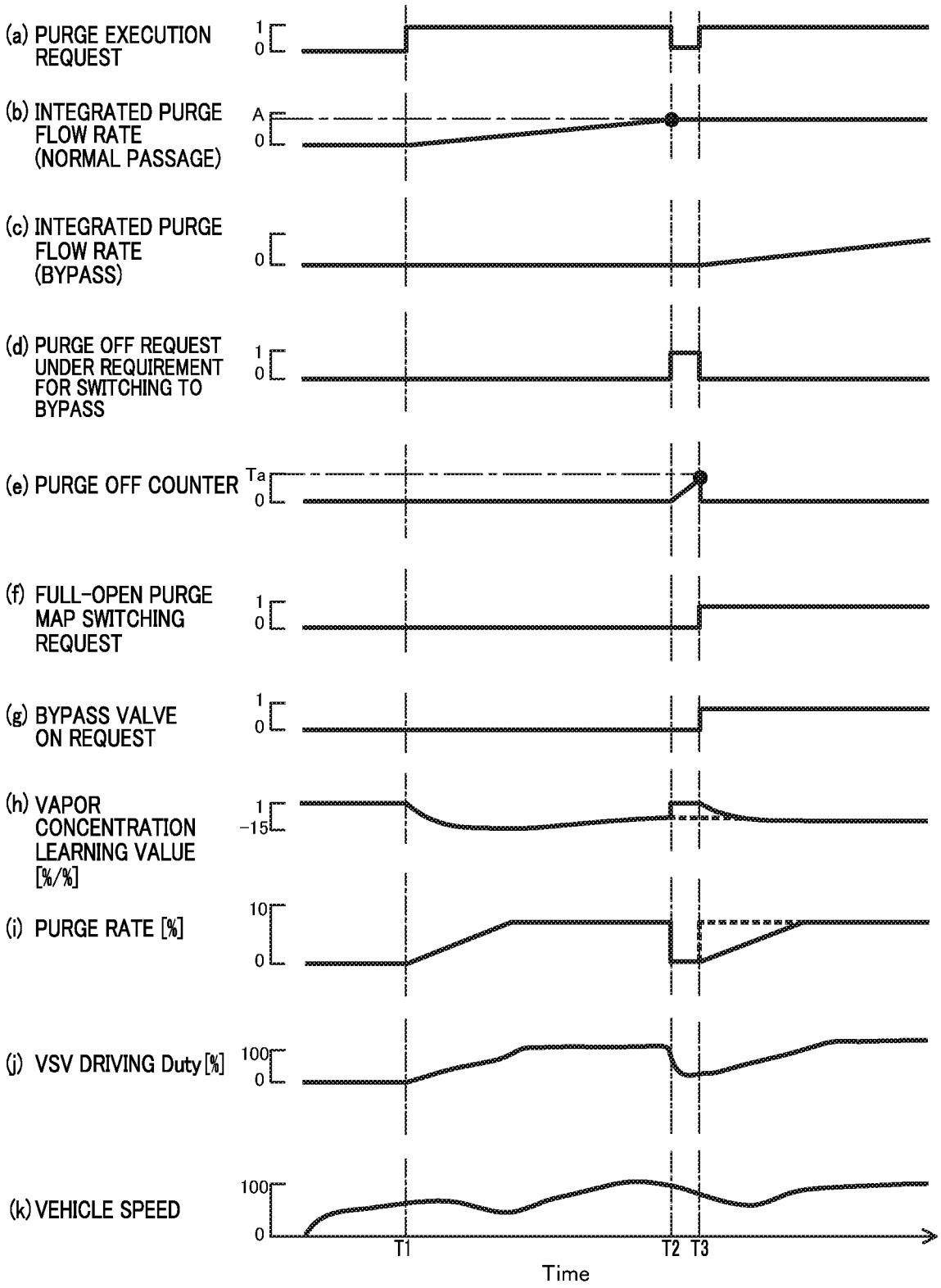
FIG. 3 is a time chart showing control details in Example 1 of the first embodiment.

Example 1 is firstly described. In this Example, as shown in FIG. 3, the controller 16 changes a purge execution request value (alternatively, a flag) to 1 and starts the purge control at time T1. At that time, the controller 16 retains a bypass valve ON request value at 0 and holds the bypass valve 32 in a closed state. Furthermore, the controller 16 retains a full-open purge map switching request at 0 and changes a purge-valve driving duty ratio according to the normal passage characteristic to control the valve opening degree of the purge valve 13.

Figure 4:
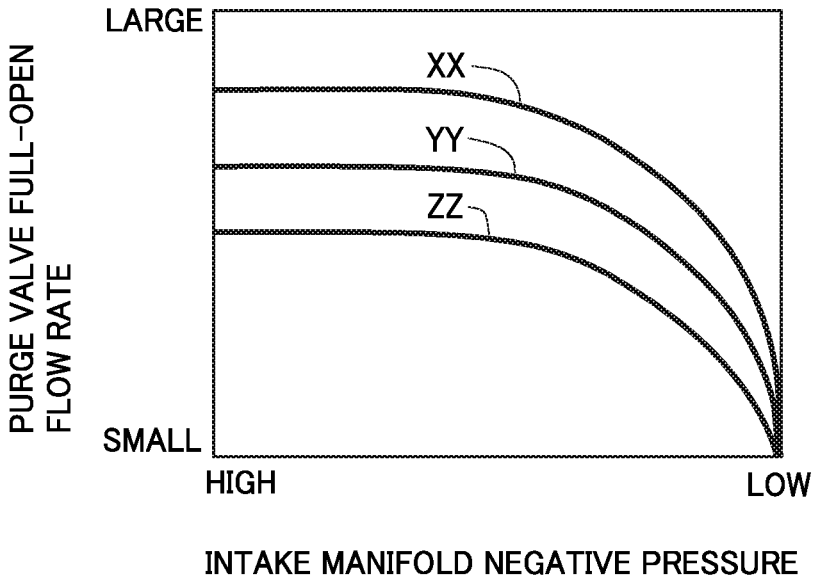
FIG. 4 is a map diagram showing a characteristic of purge-valve full-open flow rate with respect to intake manifold negative pressure.

Herein, the "normal passage characteristic" has been stored in advance in the controller 16 as a flow rate characteristic of purge gas (that is, a flow rate of purge gas in the purge passage 12) exhibited, or obtained, while the bypass valve 32 is in a closed state. Concretely, the normal passage characteristic means for example a flow rate characteristic of a purge valve in a fully-open state (namely, the characteristic of purge-valve full-open flow rate) with respect to the intake manifold negative pressure, i.e., engine negative pressure, while the bypass valve 32 is in a closed state as shown in FIG. 4. The "purge-valve full-open flow rate" represents a flow rate of purge gas when the opening degree of the purge valve 13 corresponds to a full-open position, that is, a 100% opened position.

The "purge-valve driving duty ratio" represents a duty ratio of a signal output to the purge valve 13 when the duty control is performed to adjust an open period of time of the purge valve 13. This is expressed by "VSV driving Duty" in FIG. 3 (*j*).

Subsequently, at time T2, when the integrated purge flow rate (expressed by "Integrated purge flow rate (Normal passage)" in FIG. 3 (*b*)) reaches a predetermined value A (e.g., 100 L), the controller 16 changes the purge execution request value to 0 and stops the purge control once.

After a lapse of a predetermined time Ta (e.g., 3000 ms) from time T2, i.e., at time T3, the controller 16 changes the bypass valve ON request value to 1 and turns the bypass valve 32 to an open state. At that time, the controller 16 further changes the purge execution request value to 1 and restarts the purge control.

At that time, furthermore, the controller 16 also changes the full-open purge map switching request value to 1. At or after time T3, the controller 16 changes the purge-valve driving duty ratio according to the bypass passage characteristic to control the valve opening degree of the purge valve 13. In this way, at time T3, the controller 16 changes over the flow rate characteristic of purge gas to be used for control of the valve opening degree of the purge valve 13 from the normal passage characteristic to the bypass passage characteristic.

Herein, the bypass passage characteristic has been stored in advance in the controller 16 as a flow rate characteristic of purge gas exhibited, or obtained, while the bypass valve 32 is in an open state. Concretely, the bypass passage characteristic means for example a flow rate characteristic of a purge valve in a fully-open state with respect to the intake manifold negative pressure while the bypass valve 32 is in an open state as shown in FIG. 4.

While the bypass valve 32 is in the open state, atmospheric air is introduced into the second space chamber 23-2 of the canister 11 through the atmosphere passage 14 and the bypass passage 31. Thus, during the open state of the bypass valve 32, atmospheric air hardly flows through the third-layer activated carbon 22-3 and the fourth-layer activated carbon 22-4 which may act as a resistance to a flow of air. This increases the flow rate of purge gas as compared with during the closed state of the bypass valve 32 in which atmospheric air is introduced into the canister 11 through the atmosphere passage 14 and the atmosphere port 25 of the canister 11. Accordingly, as shown in FIG. 4, the bypass passage characteristic is defined so that the flow rate of purge gas is larger than in the normal passage characteristic.

In this Example, as described above, the controller 16 is configured to stop the purge control once at the integrated purge flow rate arrival time (time T2 in FIG. 3) and, after a lapse of a predetermined time Ta (i.e., at time T3 in FIG. 3) from the stop of the purge control, turn the bypass valve 32 to an open state, restart the purge control, and adjust the valve opening degree of the purge valve 13 according to the bypass passage characteristic.

In the above manner, the controller 16 stops the purge control once at the integrated purge flow rate arrival time and then turns the bypass valve 32 to an open state and also restarts the purge control, and controls the valve opening degree of the purge valve 13 according to the bypass passage characteristic. Specifically, the controller 16 stops the purge control once at the integrated purge flow rate arrival time and then opens the bypass passage 31. Accordingly, during execution of the purge control, the controller 16 can adjust A/F variations within a permissible range, which may occur in the engine ENG due to a difference in the loss of fluid pressure in the bypass passage 31 between during a closed state and during an open state thereof, that is, a pressure loss difference in purge gas between different passages, namely, a passage through which atmospheric air (or purge gas) flows during the closed state of the bypass passage 31 and a passage through which atmospheric air (or purge gas) flows during the open state of the bypass passage 31. This can prevent A/F fluctuations from occurring while the bypass passage 31 is open. The "A/F fluctuations" mean an air-fuel ratio fluctuating situation that an air-fuel ratio in a combustion chamber (not shown) of the engine ENG excessively varies.

At or after the time when the controller 16 turns the bypass valve 32 to the open state to open the bypass passage 31, the controller 16 controls the valve opening degree of the purge valve 13 according to the bypass passage characteristic. Thus, an appropriate amount of purge gas is allowed to introduced into the engine ENG. This can prevent the occurrence of A/F fluctuations.

EXAMPLE 2

Example 2 will be described below with a focus on differences from Example 1.

Figure 5:
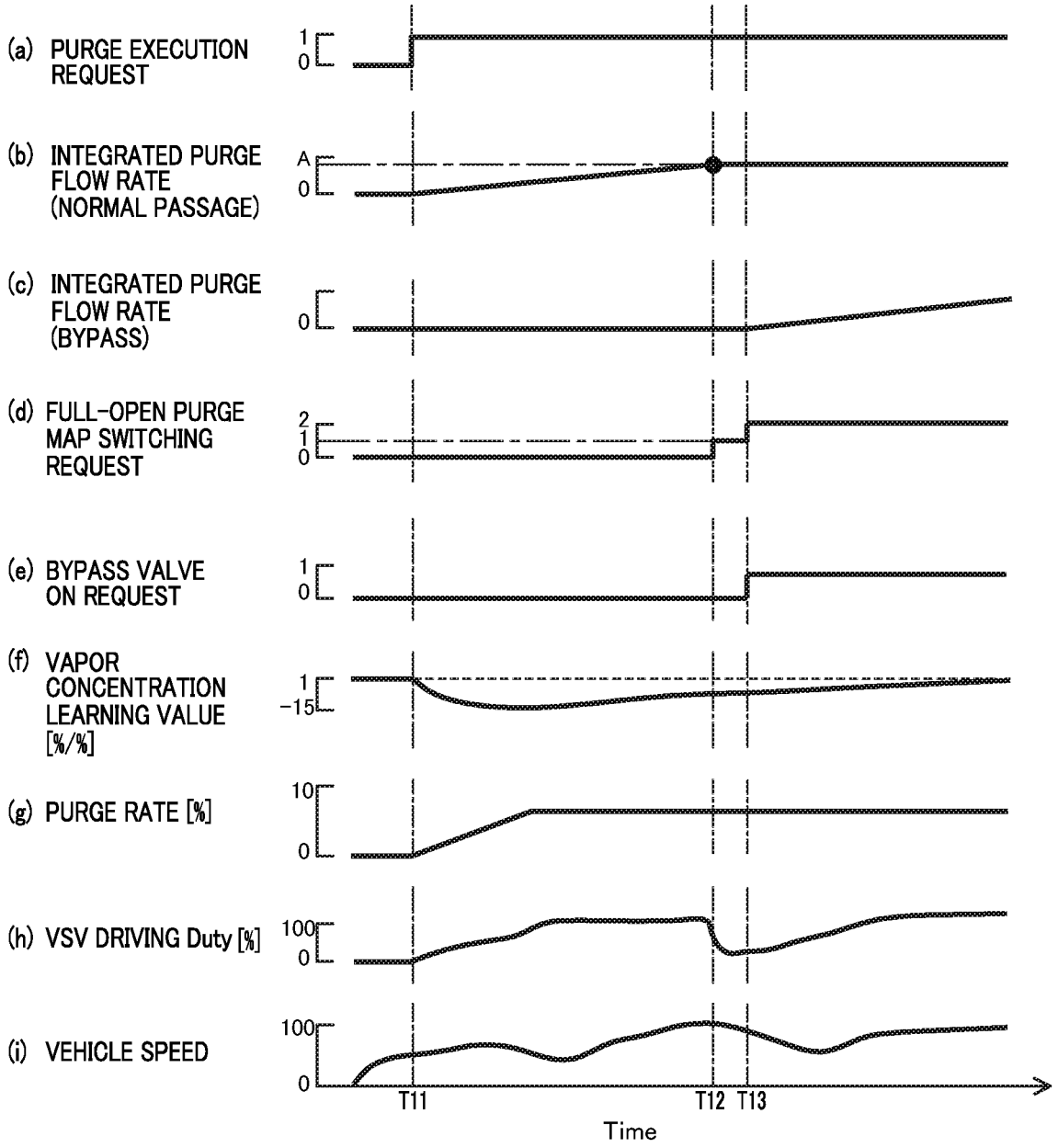
FIG. 5 is a time chart showing control details in Example 2 of the first embodiment.

In this Example, as shown in FIG. 5, differently from Example 1 (FIG. 3), even when the integrated purge flow rate reaches the predetermined value A at time T12, the controller 16 keeps the purge execution request value at 1 without stopping the purge control.

In contrast, the controller 16 also changes the full-open purge map switching request value to 1 and changes the purge-valve driving duty ratio according to the intermediate-point estimation characteristic (one example of the intermediate passage characteristic in the present disclosure) to control the opening degree of the purge valve 13. In the above manner, the controller 16 changes the flow rate characteristic of purge gas to be used for control of the opening degree of the purge valve 13 from the normal passage characteristic to the intermediate-point estimation characteristic.

Herein, the intermediate-point estimation characteristic is a characteristic stored in advance in the controller 16 as the characteristic of flow rate of purge gas. In particular, the intermediate-point estimation characteristic is for example an intermediate (concretely, an intermediate-point) characteristic between the normal passage characteristic and the bypass passage characteristic as shown in FIG. 4.

Returning to FIG. 5, at time T13, the controller 16 changes the bypass valve ON request value to 1 and turns the bypass valve 32 to the open state.

At that time, the controller 16 further changes the full-open purge map switching request value to 2 and, at or after time T13, changes the purge-valve driving duty ratio according to the bypass passage characteristic to control the opening degree of the purge valve 13. In the above way, at time T13, the controller 16 changes the flow rate characteristic of purge gas to be used for control of the opening degree of the purge valve 13 from the intermediate-point estimation characteristic to the bypass passage characteristic.

In this Example, as described above, the controller 16 is configured to control the opening degree of the purge valve 13 once according to the intermediate-point estimation characteristic at the integrated purge flow rate arrival time (T12) and subsequently turns the bypass valve 32 to the open state to control the opening degree of the purge valve 13 according to the bypass passage characteristic.

At the integrated purge flow rate arrival time, the controller 16 controls the opening degree of the purge valve 13 according to the intermediate passage characteristic once while continuing the purge control, and then turns the bypass valve 32 to the open state and controls the opening degree of the purge valve 13 according to the bypass passage characteristic. In this manner, at the integrated purge flow rate arrival time, the controller 16 opens the bypass passage 31 while changing stepwise the characteristic of flow rate of purge gas to be used for control of the opening degree of the purge valve 13. A/F fluctuations in the engine ENG, which may occur due to a pressure loss difference of a fluid in the bypass passage 31 between in the closed state and in the open state of this bypass passage 31 during execution of the purge control, can be adjusted to fall within a permissible range. The controller 16 therefore can prevent the occurrence of A/F fluctuations during the open state of the bypass passage 31 while continuing the purge process of the canister.

The "intermediate passage characteristic" in the present disclosure is not limited only to the intermediate-point estimation characteristic but may be configured of a plurality of further subdivided intermediate passage characteristics.

EXAMPLE 3

Example 3 will be described below with a focus on differences from Example 1 and Example 2.

Figure 6:
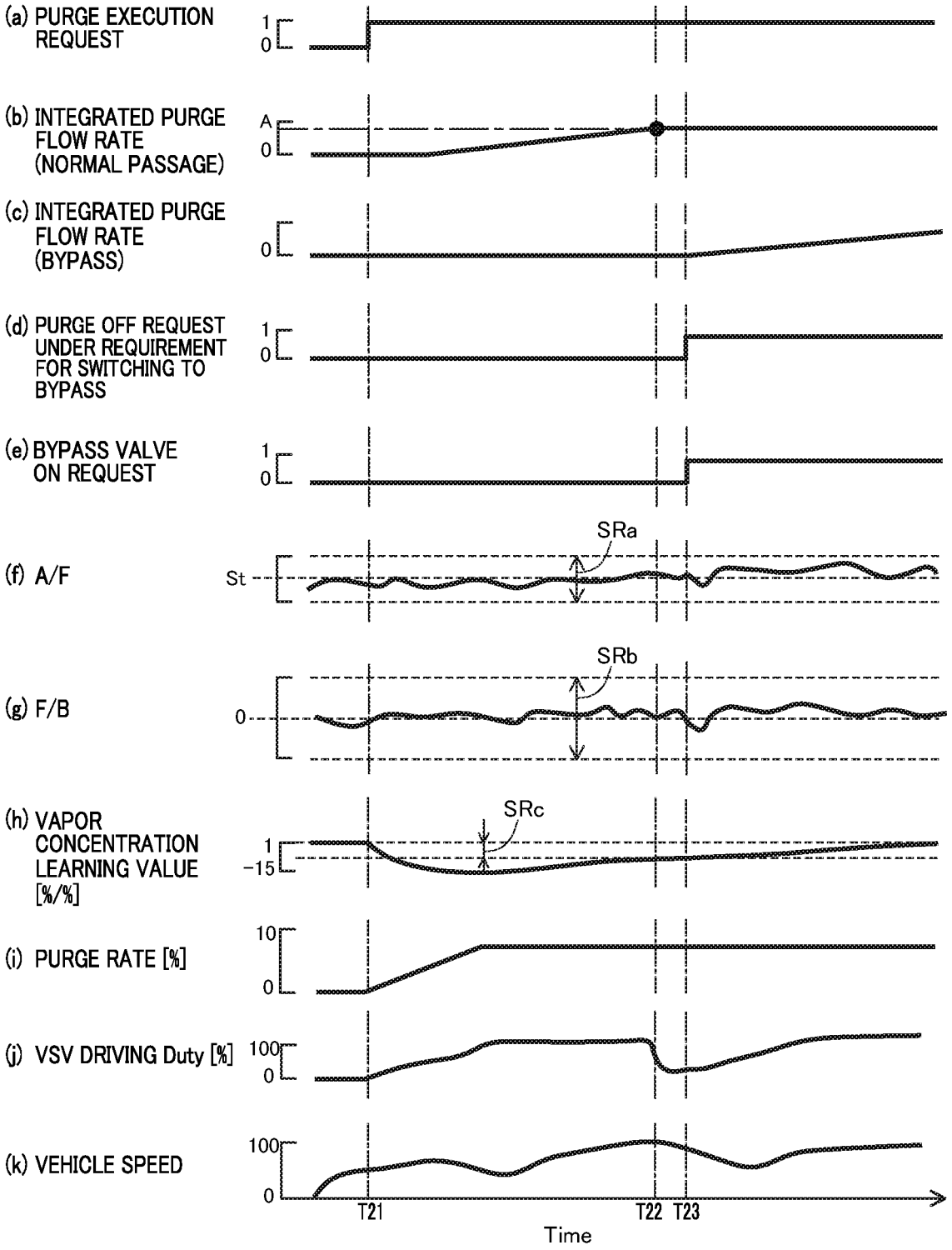
FIG. 6 is a time chart showing control details in Example 3 of the first embodiment.

In this Example, as shown in FIG. 6, differently from Example 1 (FIG. 3) and Example 2 (FIG. 5), when the integrated purge flow rate reaches the predetermined value A at time T22, if an A/F detected value (expressed by "A/F" in the figure) in the engine ENG, an INJ correction value (expressed by "F/B" in the figure), and a vapor concentration learning value fall within respective predetermined ranges SRa, SRb, and SRc, the controller 16 continues the purge control without stopping this purge control. The "INJ correction value" is an injector correction value, that is, a correction value of the injection amount of fuel to be injected from an injector INJ (one example of a fuel injection unit in the present disclosure) configured to inject fuel into the engine ENG. The "vapor concentration learning value" is a learning value of the concentration of evaporated fuel contained in purge gas. Further, a sign "St" in FIG. 6 represents an ideal air-fuel ratio.

At time T23 after a lapse of a predetermined time Tb (e.g., 3000 ms) from time T22, the controller 16 changes the bypass valve ON request value to 1 and turns the bypass valve 32 to the open state.

In this Example, when the A/F detected value in the engine ENG, the INJ correction value, and the vapor concentration learning value fall within respective predetermined ranges SRa, SRb, and SRc at the integrated purge flow rate arrival time (T22), subsequently, the controller 16 turns the bypass valve 32 to the open state while continuing the purge control and controls the opening degree of the purge valve 13 according to the bypass passage characteristic.

When the A/F detected value in the engine ENG, the INJ correction value, and the vapor concentration learning value fall within respective predetermined ranges SRa, SRb, and SRc at the integrated purge flow rate arrival time, the controller 16 places the bypass valve 32 in the open state while continuing the purge control. When it is predicted that A/F fluctuations in the engine ENG, which may occur due to a difference in pressure loss of a fluid flowing through the bypass passage 31 between in the closed state and in the open state of this bypass passage 31, can be adjusted to fall within a permissible range, the controller 16 opens the bypass passage 31 while continuously executing the purge control. This can prevent the occurrence of A/F fluctuations when the bypass passage 31 is open while the purge process of the canister 11 is continuously executed.

When at least one of the A/F detected value, the INJ correction value, and the vapor concentration learning value falls within a corresponding one of the predetermined ranges SRa, SRb, and SRc, the controller 16 may turn the bypass valve 32 to the open state while continuing the purge control.

<Control During Refueling>

Figure 7:
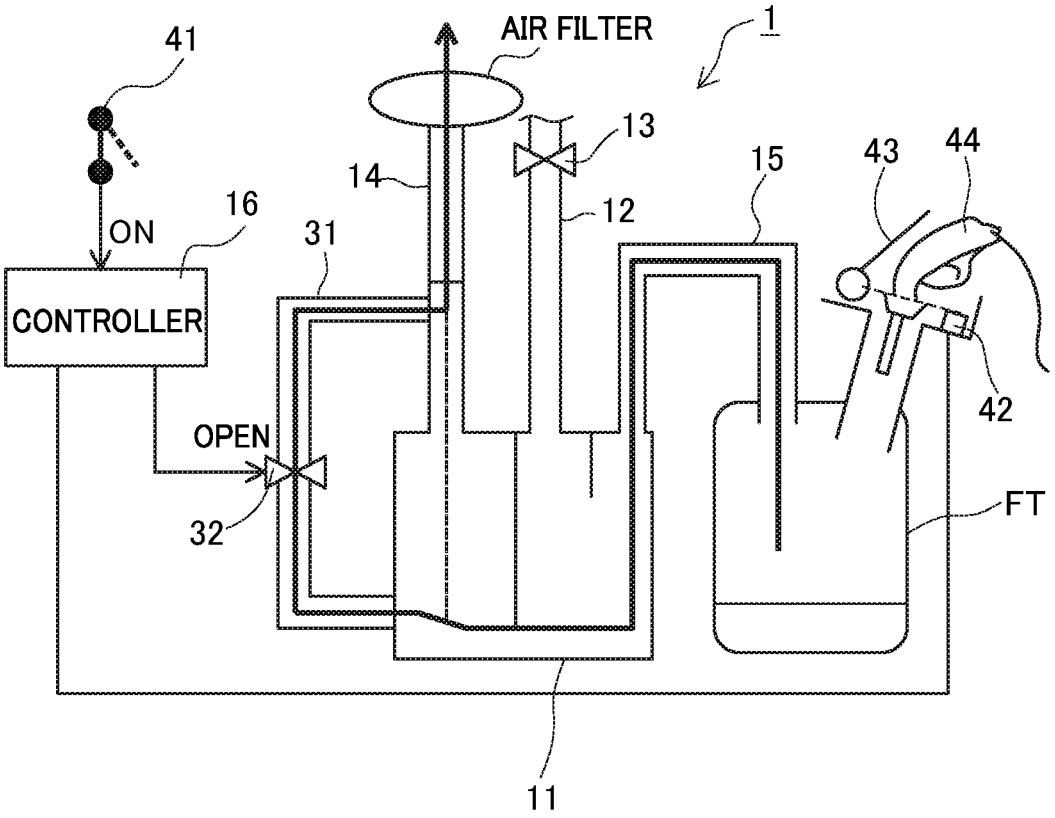
FIG. 7 is a diagram showing the evaporated fuel treatment apparatus and components for refueling.

A next description will be given to the control to be performed by the controller 16 during refueling with respect to a vehicle provided with a refueling switch 41, a lid sensor 42, a refueling lid 43, and a refueling gun 44 as shown in FIG. 7.

Figure 8:
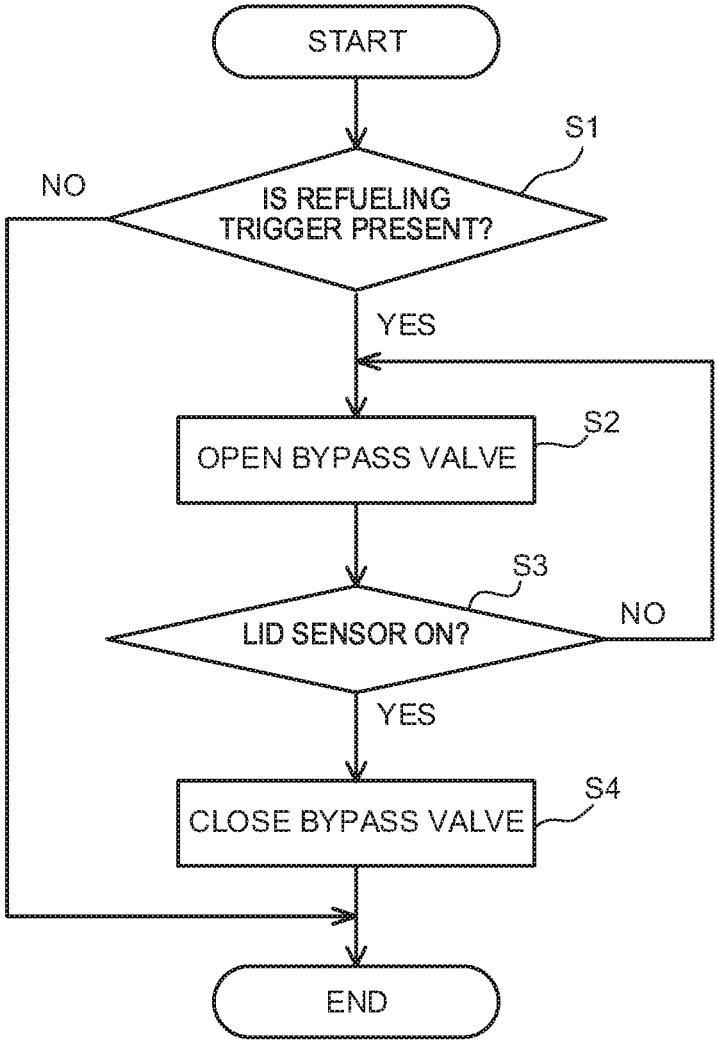
FIG. 8 is a flowchart showing control details during refueling.

To be specific, when a refueling trigger is present (step S1: YES) as shown in FIG. 8, the controller 16 turns the bypass valve 32 to the open state (step S2). This condition "when a refueling trigger is present" indicates the time when the refueling switch 41 is turned ON. When the refueling lid 43 is closed, turning the lid sensor 42 ON (step S3: YES), thereafter, the controller 16 turns the bypass valve 32 to the closed state (step S4).

Figure 9:
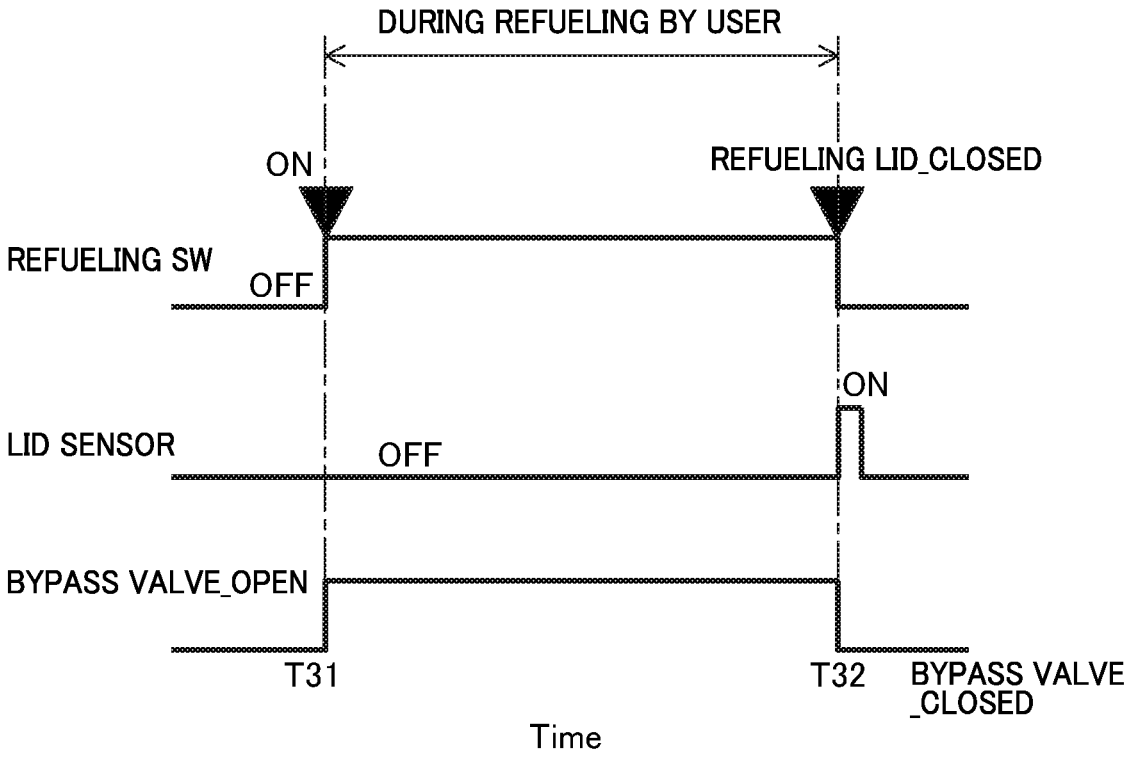
FIG. 9 is a time chart showing control details during refueling.

When the control is executed based on such a flowchart as shown in FIG. 8, a time chart shown in FIG. 9 is carried out as one example. As shown in FIG. 9, when the refueling switch 41 is turned ON at time T31, the bypass valve 32 is turned to the open state. Thereafter, the refueling lid 43 is closed and the refueling switch 41 is turned OFF at time T32, turning the lid sensor 42 ON, the bypass valve 32 is turned to the closed state.

When detecting a refueling operation based on turn-on of the refueling switch 41, the controller 16 turns the bypass valve 32 to the open state to open the bypass passage 31. Accordingly, the pressure in the fuel tank FT is allowed to escape through the bypass passage 31 and thus does not excessively increase. Thus, the refueling gun 44 is prevented from automatically stopping before the fuel tank FT is not sufficiently supplied with fuel. Consequently, the fuel tank FT can be reliably filled with fuel during refueling. As an alternative, the controller 16 may be configured to detect the refueling operation based on any means other than the refueling switch 41.

Second Embodiment

A second embodiment will be described below with a focus on differences from the first embodiment. In the following description, the same or similar components as those in the first embodiment are assigned the same reference signs and their details are omitted.

<Outline of Evaporated Fuel Treatment Apparatus>

Figure 10:
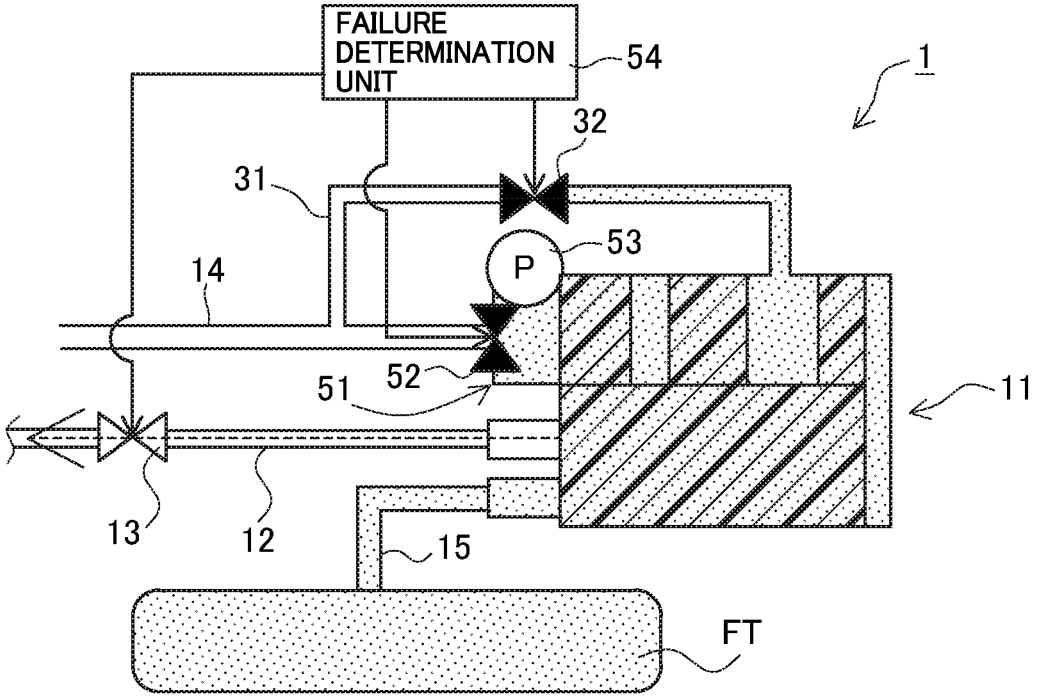
FIG. 10 is an entire configuration diagram of the evaporated fuel treatment apparatus in a second embodiment, showing a state for preliminary diagnosis and a state for secondary determination.

In the present embodiment, as shown in FIG. 10, the evaporated fuel treatment apparatus 1 includes, differently from that in FIG. 1, a key-off pump 51 for use in failure diagnoses placed at a connection part of the canister 11 connected to the atmosphere passage 14. This key-off pump 51 is provided with a switching valve 52 (one example of an "atmosphere passage on-off valve" in the present disclosure) and a pressure sensor 53 (one example of a "pressure detecting unit" in the present disclosure).

The switching valve 52 is placed at a position close to the canister 11 relative to a branch point of the bypass passage 31 branching from the atmosphere passage 14, that is, at a position downstream in an atmospheric air flowing direction and configured to open and close the atmosphere passage 14. This switching valve 52 is a normally-open valve. The pressure sensor 53 is configured to detect the pressure in the atmosphere passage 14 at a position downstream of the switching valve 52 in the atmospheric air flowing direction.

The evaporated fuel treatment apparatus 1 further includes a failure determination unit 54. This failure determination unit 54 may be provided as a part of the controller 16 or a separate part from the controller 16.

<Failure Determination>

In the present embodiment, during execution of the purge control, the failure determination unit 54 is configured to determine whether or not the purge valve 13, the bypass valve 32, and the switching valve 52 are in a failure state based on a detected value of the pressure sensor 53 obtained when the bypass valve 32 and the switching valve 52 are individually switched between an open state and a closed state.

EXAMPLE 1

Figure 11:
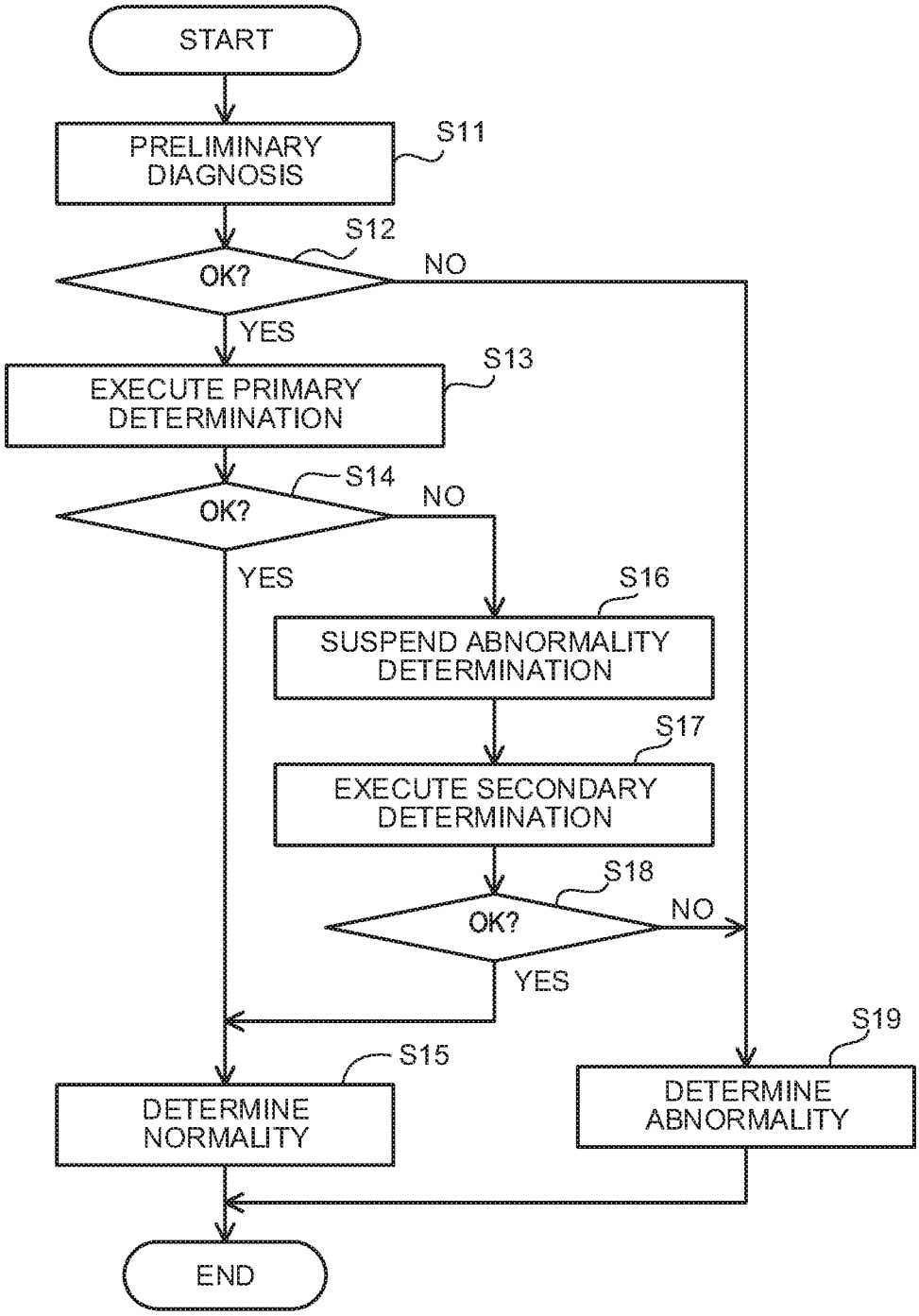
FIG. 11 is a flowchart showing details of a failure determination method in Example 1 of the second embodiment.

Therefore, Example 1 for failure determination will be described. In this Example, the failure determination unit 54 performs a preliminary diagnosis for preliminarily diagnosing whether or not a purge gas is leaking (also referred to as "purge-flow leak preliminary diagnosis") (step S11) as shown in FIG. 11.

In this preliminary diagnosis, as shown in FIG. 10, during execution of the purge control, the failure determination unit 54 places the purge valve 13 in the open state (a state illustrated by an outline form in the figure) and places the bypass valve 32 and the switching valve 52 in the closed state (a state illustrated by a black solid form in the figure). When the detected value of the pressure sensor 53 is less than a first determination value JVa, the failure determination unit 54 determines that the purge valve 13 is not in a close failure state, i.e., does not remain closed by failure, and determines that the bypass valve 32 and the switching valve 52 are not in an open failure state, i.e., do not remain opened by failure, and thus judges that the result of the preliminary diagnosis is affirmative (no failure). The first determination value JVa is a negative value. The "close failure" means a failure condition that a valve remains closed while it is controlled to open, that is, the valve fails to open. The "open failure" means a failure condition that a valve remains open while it is controlled to close, that is, the valve fails to close.

Returning to FIG. 11, when the preliminary diagnosis result is affirmative (step S12: YES), the controller 16 performs a primary determination (step S13).

Figure 12:
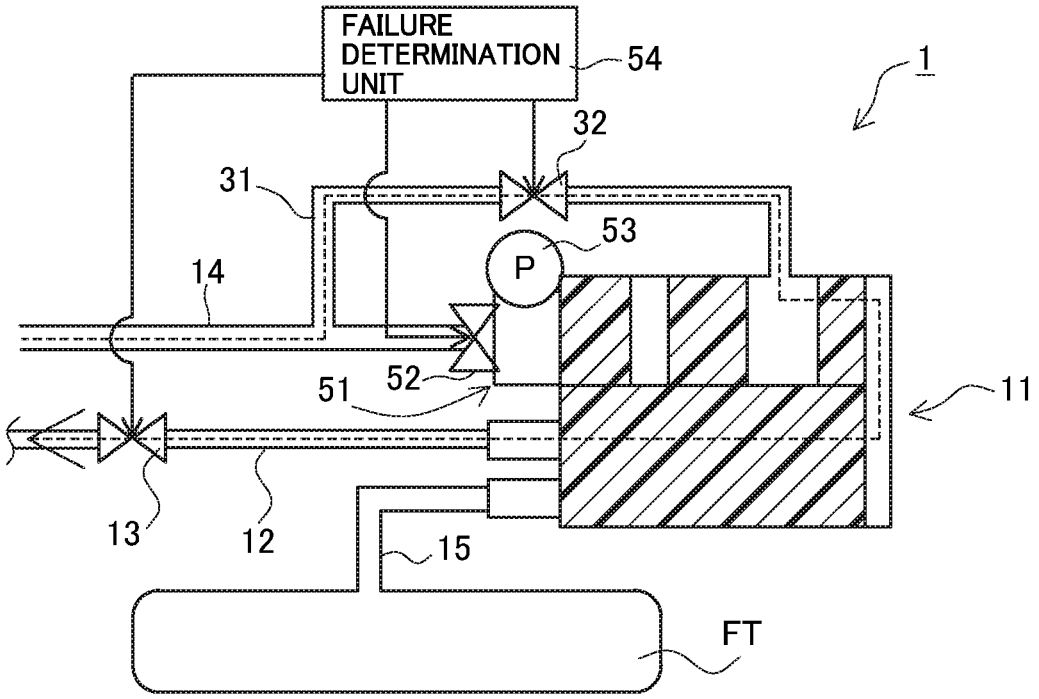
FIG. 12 is an entire configuration diagram of the evaporated fuel treatment apparatus in the second embodiment, showing a state for primary determination.

In this primary determination, as shown in FIG. 12, the failure determination unit 54 places all of the purge valve 13, the bypass valve 32, and the switching valve 52 in the open state during execution of the purge control. When the detected value of the pressure sensor 53 is equal or larger than a second determination value JVb, the failure determination unit 54 determines that the bypass valve 32 is not in the close failure state and judges that the result of the primary determination is affirmative. The second determination value JVb is a pressure value (a pressure value on a positive pressure side) higher than the first determination value JVa.

Returning to FIG. 11, if the primary determination result is affirmative (step S14: YES), the failure determination unit 54 then determines the normality (Normality determination), that is, determines that the bypass valve 32 is normal (step S15).

If the primary determination result in step S12 is negative (step S12: NO), the failure determination unit 54 then determines the abnormality (Abnormality determination), that is, determines that the the purge valve 13, the bypass valve 32, or the switching valve 52 is abnormal (step S19).

If the primary determination result is negative in step S14 (step S14: NO), that is, if the detected value of the pressure sensor 53 is less than the second determination value JVb, the failure determination unit 54 suspends the abnormality determination (step S16) and instead performs a secondary determination (step S17).

In this secondary determination, similar to the preliminary diagnosis shown in FIG. 10, during execution of the purge control, the failure determination unit 54 places the purge valve 13 in the open state and each of the bypass valve 32 and the switching valve 52 in the closed state. If the detected value of the pressure sensor 53 is less than the first determination value JVa, the failure determination unit 54 determines that the bypass valve 32 is not in the open failure state and thus judges that the result of the secondary determination is affirmative. In contrast, if the detected value of the pressure sensor 53 remains equal to or larger than the first determination value JVa, the failure determination unit 54 determines that the bypass valve 32 may be in the open failure state, and thus judges the secondary determination result is negative.

Returning to FIG. 11, if the secondary determination result is affirmative (step S18: YES), the failure determination unit 54 determines the normality (step S15). In contrast, if the secondary determination result is negative (step S18: NO), the failure determination unit 54 determines the abnormality (step S19).

Figure 13:
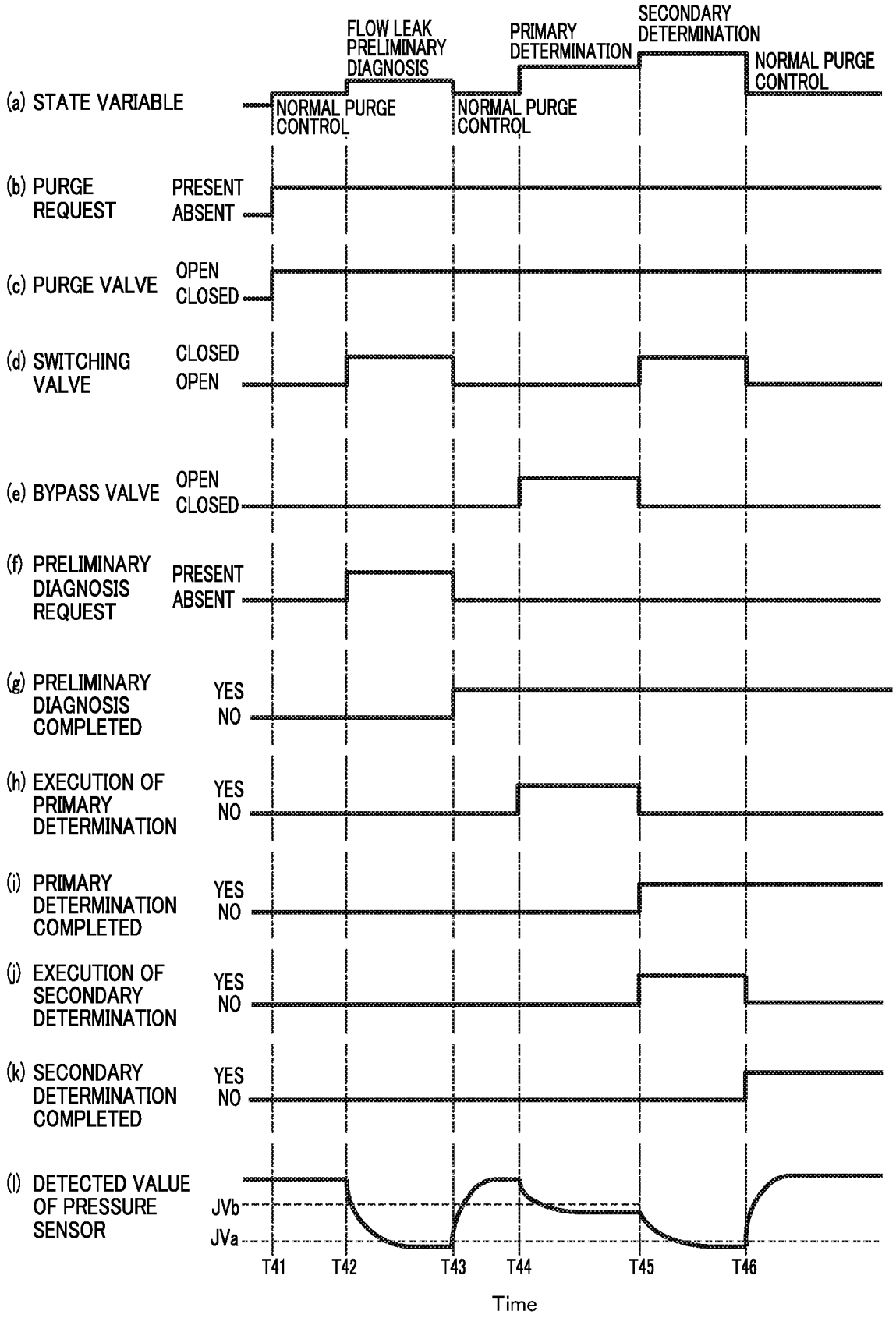
FIG. 13 is a time chart showing one example of details to be executed by the failure determination method in Example 1 of the second embodiment.

When the failure determination is executed based on such a flowchart as shown in FIG. 11, a time chart shown in FIG. 13 is carried out as one example. As shown in FIG. 13, the purge valve 13 is turned to the open state at time T41 and the purge control is started. At that time, the bypass valve 32 is in the closed state and the switching valve 52 is in the open state. Thereafter, at time T42, the switching valve 52 is changed to the closed state and the preliminary diagnosis (expressed by "flow leak preliminary diagnosis" in the figure) is performed. Then, when the detected value of the pressure sensor 53 becomes less than the first determination value JVa in the preliminary diagnosis, the preliminary diagnosis is completed at time T43. At that time, the switching valve 52 is changed to the open state.

Thereafter, the normal purge control is executed. At time T44, the bypass valve 32 is turned to the open state and the primary determination is started. In this primary determination, the detected value of the pressure sensor 53 becomes less than the second determination value JVb. At time T45, the primary determination is completed and the secondary determination is started. In this secondary determination, the detected value of the pressure sensor 53 becomes less than the first determination value JVa. At time T46, the secondary determination is completed.

EXAMPLE 2

Figure 14:
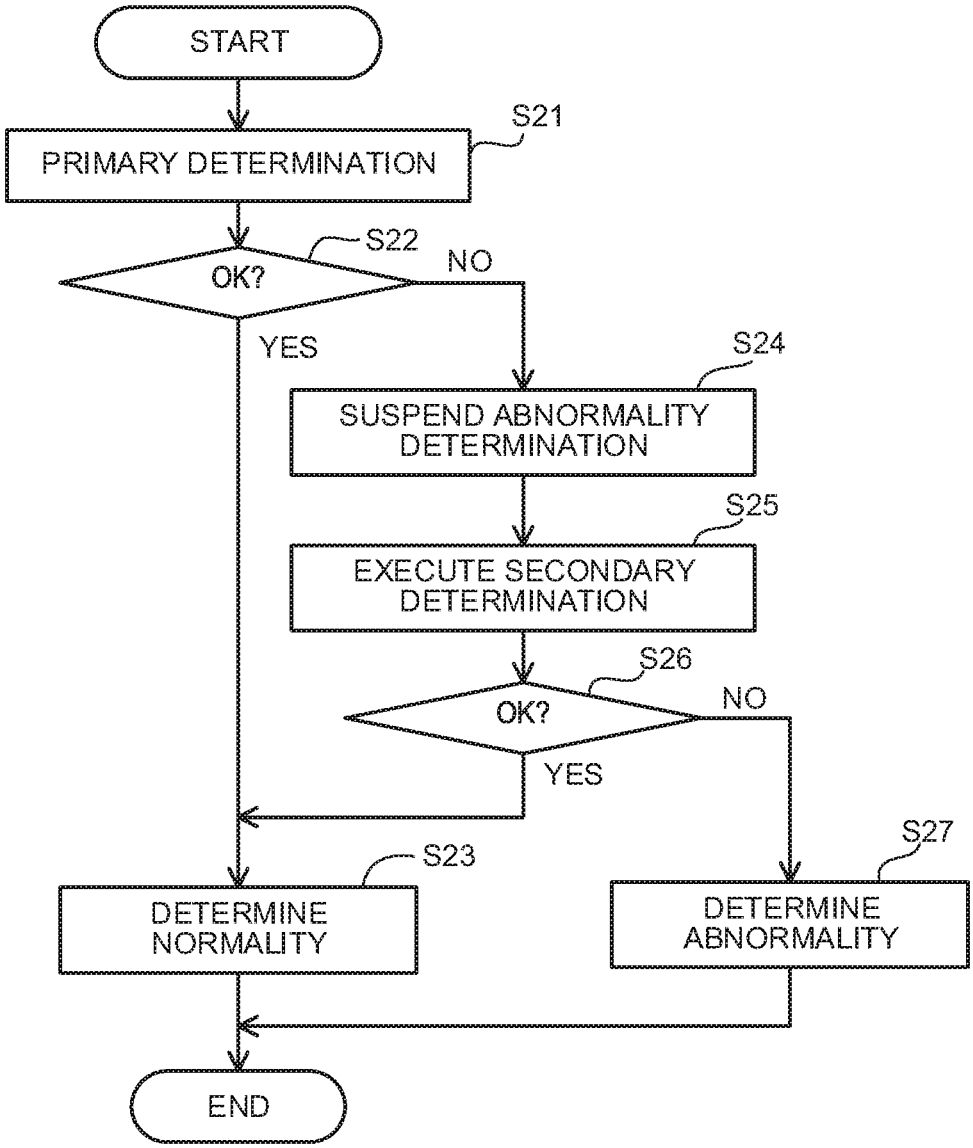
FIG. 14 is a flowchart showing details of the failure determination method in Example 2 of the second embodiment.
Figure 15:
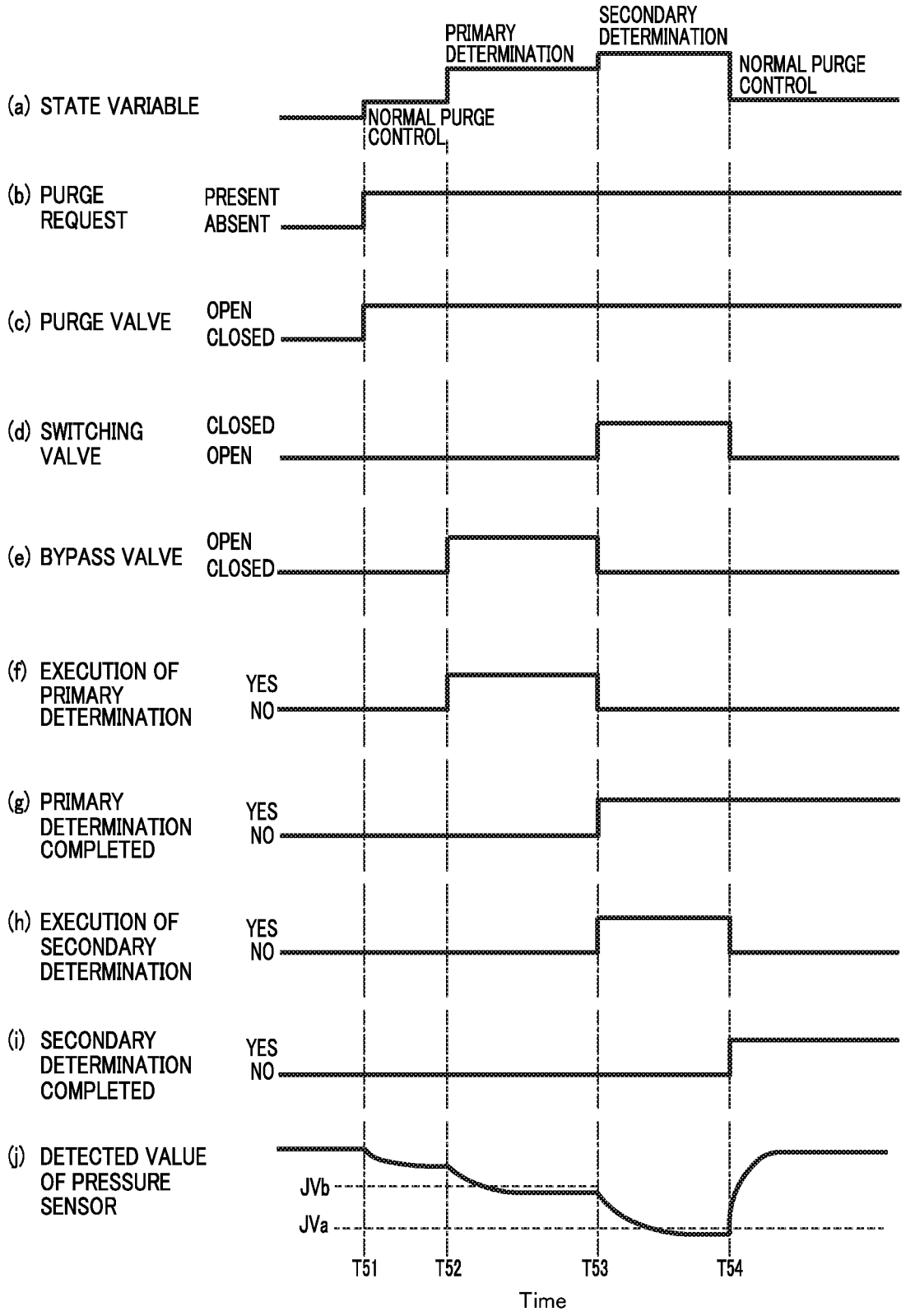
FIG. 15 is a time chart showing one example of details to be executed by the failure determination method in Example 2 of the second embodiment.

Example 2 of the failure determination will be described below. This Example exemplifies that execution of the preliminary diagnosis is unnecessary. Thus, the failure determination unit 54 performs the primary determination and the secondary determination as shown in FIGS. 14 and 15 without executing the preliminary diagnosis. The processing details in step S21 to step S27 shown in FIG. 14 are the same as those in step S13 to step S19 shown in FIG. 11 and therefore their description is omitted herein. Further, the processing details to be carried out at time T51 to time T54 shown in FIG. 15 are the same as those to be carried out at time T43 to time T46 shown in FIG. 13 and therefore their description is omitted herein.

<Operations and Effects of Present Embodiment>

According to the present embodiment, the failure determination unit 54 is configured to determine whether or not the purge valve 13, the bypass valve 32, and the switching valve 52 are in a failure state based on each detected value of the pressure sensor 53 obtained when the bypass valve 32 and the switching valve 52 are individually switched between the open state and the closed state during execution of the purge control.

In the above manner, the failure determination of the bypass valve 32 and others is performed based on pressure changes in the evaporated fuel treatment apparatus 1 during execution of the purge control. Based on such a determination result, the failure of the bypass valve 32 and others can be detected to ensure operations of the bypass valve 32 and others.

Since the switching valve 52 is a normally-open valve, the switching valve 52 has only to be driven to come to the closed state only as needed, such as during the preliminary diagnosis or the secondary determination. This can reduce power consumption to device the switching valve 52.

Third Embodiment

A third embodiment will be described below with a focus on differences from the first embodiment and the second embodiment. In the following description, the same or similar components as those in the first and second embodiments are assigned the same reference signs and their details are omitted.

<Outline of Evaporated Fuel Treatment Apparatus>

Figure 16:
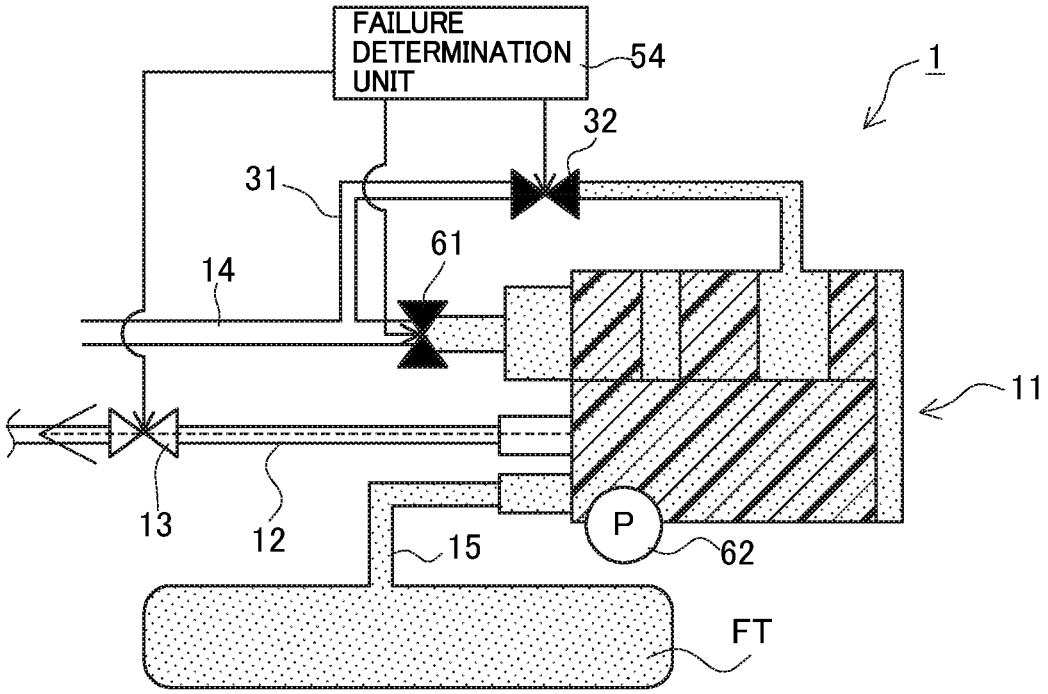
FIG. 16 is an entire configuration diagram of the evaporated fuel treatment apparatus in a third embodiment, showing a state for preliminary diagnosis and a state for secondary determination.

In the present embodiment, as shown in FIG. 16, the evaporated fuel treatment apparatus 1 includes a CCV 61 (one example of an atmosphere passage on-off valve in the present disclosure) and a pressure sensor 62 (one example of a pressure detecting unit in the present disclosure). The CCV 61 is a canister close valve configured to open and close the atmosphere passage 14. Further, the pressure sensor 62 is placed at a position close to the purge port 24 of the canister 11 (see FIG. 1 and others).

<Failure Determination>

In the present embodiment, during execution of the purge control, the failure determination unit 54 is configured to determine whether or not the purge valve 13, the bypass valve 32, and the CCV 61 are in a failure state based on a detected value of the pressure sensor 62 obtained when the bypass valve 32 and the CCV 61 are individually switched between the open state and the closed state.

EXAMPLE 1

Thus, Example 1 for failure determination will be described. In this Example, the failure determination unit 54 performs the preliminary diagnosis, the primary determination, and the secondary determination as shown in FIG. 11.

In this Example, in the preliminary diagnosis, during execution of the purge control, the failure determination unit 54 places the purge valve 13 in the open state and the bypass valve 32 and the CCV 61 in the closed state as shown in FIG. 16. If the detected value of the pressure sensor 62 becomes less than the first determination value JVa, the failure determination unit 54 determines that the purge valve 13 is not in the close failure state, and determines that the bypass valve 32 and the CCV 61 are not in the open failure state, and thus judges that the result of the preliminary diagnosis is affirmative.

Figure 17:
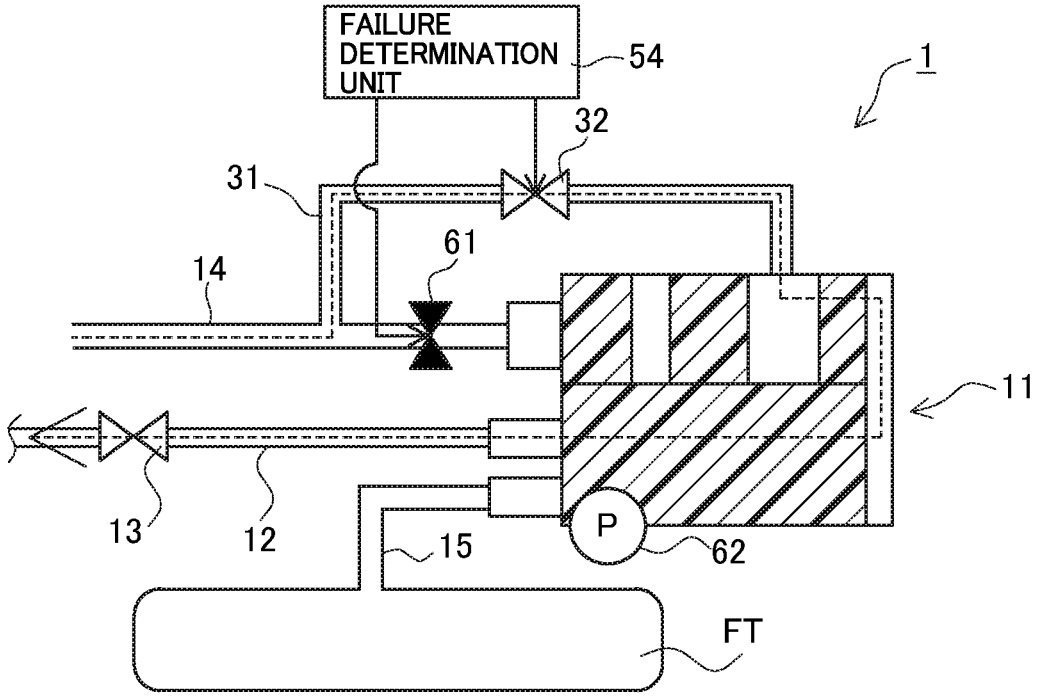
FIG. 17 is an entire configuration diagram of the evaporated fuel treatment apparatus in a third embodiment, showing a state for primary determination.

In the primary determination, as shown in FIG. 17, the failure determination unit 54 holds the purge valve 13 in the open state and the CCV 61 in the closed state, but places the bypass valve 32 in the open state. If the detected value of the pressure sensor 62 is equal to or larger than the second determination value JVb, the failure determination unit 54 determines that the bypass valve 32 is not in the close failure state and thus judges that the result of the primary determination is affirmative.

In the secondary determination, similar to the preliminary diagnosis shown in FIG. 16, the failure determination unit 54 places the purge valve 13 in the open state and places the bypass valve 32 and the CCV 61 in the closed state during execution of the purge control. If the detected value of the pressure sensor 62 becomes less than the first determination value JVa, the failure determination unit 54 determines that the bypass valve 32 is not in the close failure state and thus judges the result of the secondary determination is affirmative. In contrast, if the detected value of the pressure sensor 62 does not become less than the first determination value JVa, that is, remains equal to or larger than the first determination value JVa, the failure determination unit 54 determines that the bypass valve 32 may be in the closed failure state and thus judges that the result of the secondary determination is negative.

Figure 18:
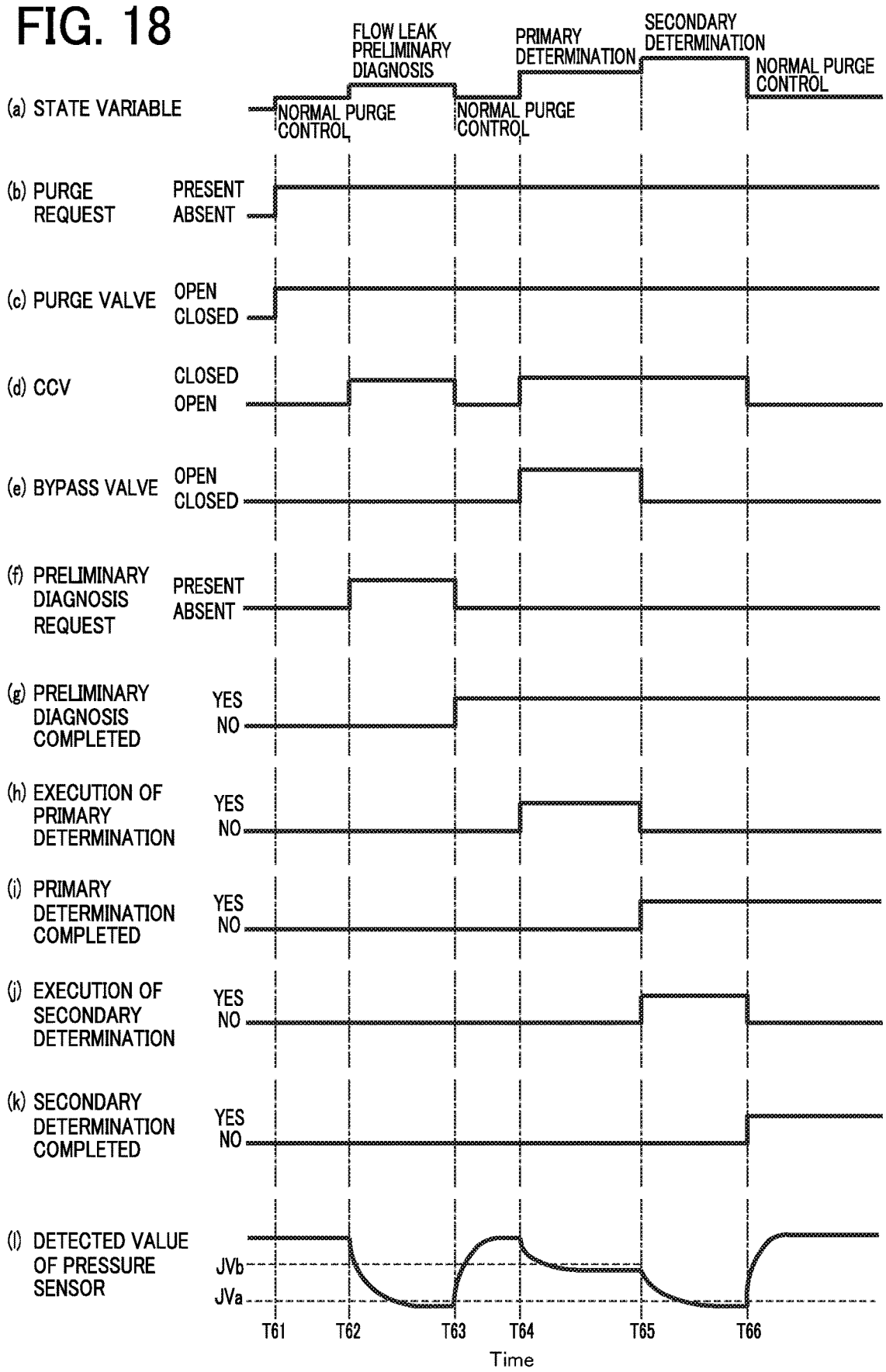
FIG. 18 is a time chart showing one example of details to be executed by the failure determination method in Example 1 of the third embodiment.

When the failure determination is performed on such a flowchart as shown in FIG. 11, a time chart shown in FIG. 18 is carried out as one example. As shown in FIG. 18, the purge valve 13 is tuned to the open state at time T61 and the purge control is started. At that time, the bypass valve 32 is in the closed state and the CCV 61 is in the open state. Thereafter, at time T62, the CCV 61 is turned to the closed state and the preliminary diagnosis (expressed by "flow leak preliminary diagnosis" in the figure) is performed. In this preliminary diagnosis, the detected value of the pressure sensor 62 becomes less than the first determination value JVa. Then, at time T63, the preliminary diagnosis is completed. At that time, the CCV 61 is turned to the open state.

Thereafter, the normal purge control is executed. At time T64, the bypass valve 32 is turned to the open state and the primary determination is started. In this primary determination, the detected value of the pressure sensor 62 becomes less than the second determination value JVb. At time T65, the primary determination is completed and the secondary determination is started. In this secondary determination, the detected value of the pressure sensor 62 becomes less than the first determination value JVa. At time T66, the secondary determination is completed.

EXAMPLE 2

Figure 19:
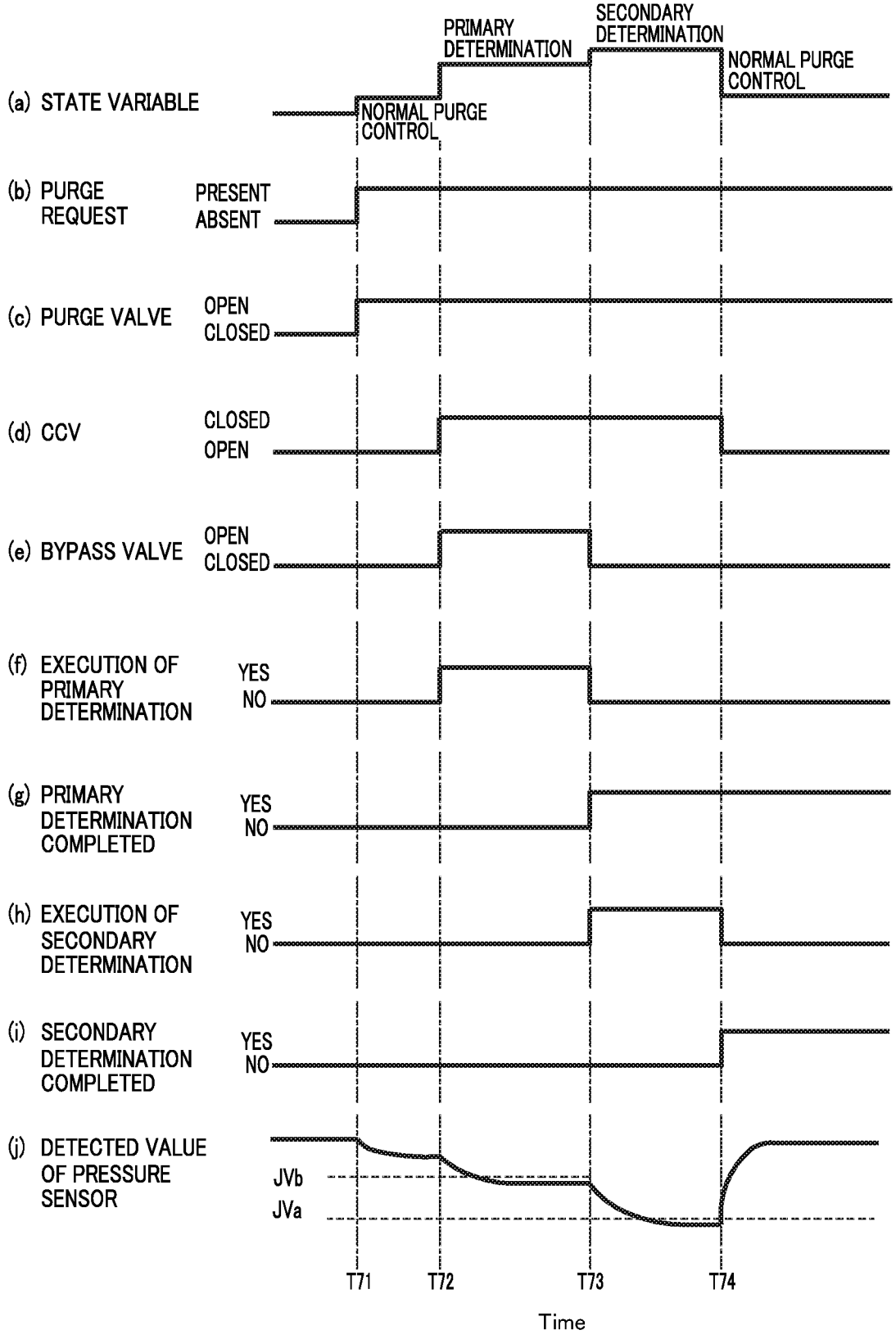
FIG. 19 is a time chart showing one example of details to be executed by the failure determination method in Example 2 of the third embodiment.

Next, Example 2 for the failure determination will be described. This Example exemplifies that execution of the preliminary diagnosis is unnecessary. Thus, the failure determination unit 54 performs the primary determination and the secondary determination as shown in FIGS. 15 and 19 without executing the preliminary diagnosis. The processing details to be carried out at time T71 to time T74 shown in FIG. 19 are the same as those to be carried out at time T63 to time T66 shown in FIG. 18 and therefore their description is omitted herein.

<Operations and Effects of Present Embodiment>

According to the present embodiment, the failure determination unit 54 is configured to determine whether or not the purge valve 13, the bypass valve 32, and the CCV 61 are in a failure state based on each detected value of the pressure sensor 62 obtained when each of the bypass valve 32 and the CCV 61 is switched between the open state and the closed state during execution of the purge control.

In the above manner, the failure determination of the bypass valve 32 and others is performed based on pressure changes in the evaporated fuel treatment apparatus 1 during execution of the purge control. Based on such a determination result, the failure of the bypass valve 32 and others can be detected to ensure operations of the bypass valve 32 and others.

The foregoing embodiments are mere examples and give no limitation to the present disclosure. The present disclosure may be embodied in other specific forms without departing from the essential characteristics thereof.

For instance, the activated carbon 22 has only to be provided in more than one place, not limited to four places exemplified as above. As the adsorbent, any materials other than activated carbon may be used. The number of the activated carbons 22 around which the bypass passage 31 detours is not particularly limited and may be one or more than one.

REFERENCE SIGNS LIST

1 Evaporated fuel treatment apparatus
11 Canister
12 Purge passage
13 Purge valve
14 Atmosphere passage
16 Controller
22 Activated carbon
22-1 First-layer activated carbon
22-2 Second-layer activated carbon
22-3 Third-layer activated carbon
22-4 Fourth-layer activated carbon
23 Space chamber
23-1 First chamber
23-2 Second chamber
23-3 Third chamber
25 Atmosphere port
31 Bypass passage
32 Bypass valve
33 Integrated flow rate detecting unit
41 Refueling switch
42 Lid sensor
43 Refueling lid
44 Refueling gun
51 Key-off pump
52 Switching valve
53 Pressure sensor
54 Failure detection unit
61 CCV
62 Pressure sensor
FT Fuel tank
IP Intake passage
ENG Engine
INJ Injector
A Predetermined value
Ta Predetermined time
Tb Predetermined time
SRa Predetermined range
SRb Predetermined range
SRc Predetermined range
JVa First determination value
JVb Second determination value

What is claimed is:

1. An evaporated fuel treatment apparatus comprising:

a canister including a plurality of adsorption layers for adsorbing evaporated fuel and a space layer that is a space formed between the adsorption layers;

a purge passage configured to allow purge gas containing the evaporated fuel to flow from the canister to an engine;

a purge valve configured to open and close the purge passage;

an atmosphere passage configured to take atmospheric air into the canister;

a controller configured to perform purge control by placing the purge valve in an open state to introduce the purge gas from the canister into the engine through the purge passage;

a bypass passage branching off from the atmosphere passage and connecting to the canister by detouring around at least one of the adsorption layers; and a bypass valve configured to open and close the bypass passage, wherein, after start of the purge control, the controller is configured to hold the bypass valve in a closed state until an integrated purge flow rate reaches a predetermined value, the integrated purge flow rate being an integration value of flow rates of the purge gas flowing through the purge passage, and then turn the bypass valve to an open state when the integrated purge flow rate reaches the predetermined value.

2. The evaporated fuel treatment apparatus according to claim 1, wherein at an integrated purge flow rate arrival time at which the integrated purge flow rate reaches the predetermined value, the controller is configured to stop the purge control once, and after a predetermined time elapses from stop of the purge control, the controller is configured to turn the bypass valve to the open state and restart the purge control, and control a valve opening degree of the purge valve according to a bypass passage characteristic corresponding to a flow rate characteristic of the purge gas exhibited while the bypass valve is in the open state.

3. The evaporated fuel treatment apparatus according to claim 1, wherein at an integrated purge flow rate arrival time at which the integrated purge flow rate reaches the predetermined value, the controller is configured to:

control a valve opening degree of the purge valve once according to an intermediate passage characteristic corresponding to an intermediate characteristic between a normal passage characteristic corresponding to a flow rate characteristic of the purge gas exhibited while the bypass valve is in the closed state and a bypass passage characteristic corresponding to a flow rate characteristic of the purge gas exhibited while the bypass valve is in the open state; and change the bypass valve to the open state and control the valve opening degree of the purge valve according to the bypass passage characteristic.

4. The evaporated fuel treatment apparatus according to claim 1, wherein at an integrated purge flow rate arrival time at which the integrated purge flow rate reaches the predetermined value, when at least one of a detected A/F value of the engine, a correction value of fuel in a fuel injection unit configured to inject a fuel into the engine, and a learning value of concentration of the evaporated fuel contained in the purge gas falls within a predetermined range, the controller is configured to turn the bypass valve to the open state while continuing the purge control, and control a valve opening degree of the purge valve according to a bypass passage characteristic corresponding to a flow rate characteristic of the purge gas exhibited while the bypass valve is in the open state.

5. The evaporated fuel treatment apparatus according to claim 1 further including:

an atmosphere passage on-off valve placed in the atmosphere passage at a position close to the canister relative to a branch point from the bypass passage, the atmosphere passage on-off valve being configured to open and close the atmosphere passage;

a pressure detecting unit configured to detect pressure in the atmosphere passage at a position downstream of the atmosphere passage on-off valve; and a failure determination unit configured to determine whether or not the purge valve, the bypass valve, and the atmosphere passage on-off valve are in a failure state, during execution of the purge control, based on a detected value of the pressure detecting unit obtained when the bypass valve and the atmosphere passage on-off valve are individually switched between an open state and a closed state.

6. The evaporated fuel treatment apparatus according to claim 1, wherein the controller is configured to turn the bypass valve to the open state when the controller detects a refueling operation.

* * * * *